US005668346A

United States Patent [19]

Kunz et al.

[11] Patent Number: 5,668,346

[45] Date of Patent: Sep. 16, 1997

[54] SUBMUNITION

[75] Inventors: Jürgen Kunz, Reichenschwand; Max Rentzsch, Schnaittach, both of Germany

[73] Assignee: Diehl GmbH & Co., Nuremberg, Germany

[21] Appl. No.: 630,376

[22] Filed: Apr. 10, 1996

[30] Foreign Application Priority Data

May 8, 1995 [DE] Germany ..... 295 07 361.6

[51] Int. Cl.[6] ..... F42B 10/56

[52] U.S. Cl. ..... 102/387; 102/211; 102/389; 102/495

[58] Field of Search ..... 102/211, 213, 102/214, 305, 306, 382, 384, 386, 387, 388, 389, 393, 475, 476, 489, 491–497

[56] References Cited

U.S. PATENT DOCUMENTS

| | | | |
|---|---|---|---|
| 3,853,059 | 12/1974 | Moe | 102/475 |
| 4,050,381 | 9/1977 | Heinemann . | |
| 4,538,519 | 9/1985 | Witt et al. | 102/475 |
| 4,773,328 | 9/1988 | Germershausen | 102/214 |
| 4,974,515 | 12/1990 | Busch et al. . | |
| 5,003,882 | 4/1991 | Frehaut et al. | 102/387 |

FOREIGN PATENT DOCUMENTS

| | | |
|---|---|---|
| 2196456 | 3/1974 | France . |
| 2478297 | 9/1981 | France . |
| 2340653 | 4/1974 | Germany . |
| 3900442 | 7/1990 | Germany . |
| 9015932.2 | 4/1991 | Germany . |
| 40 22 445 | 1/1992 | Germany . |
| 2 144 523 | 4/1985 | United Kingdom . |

*Primary Examiner*—Harold J. Tudor
*Attorney, Agent, or Firm*—Scully, Scott, Murphy & Presser

[57] ABSTRACT

For attacking semi-hard target objects (21) even in a semi-covered position (for the avoidance of the munition-technical expenditure on the intelligent search-fuse submunition with P-charge against hard targets), there is provided a scatter munition whose warhead (22 ) descends into the target area (12 ), hanging on a rotational parachute (13), and triggers off a fragment cone of heavy metal balls (23) inclinedly downwardly as soon as a search-fuse sensor (19) which is oriented parallel to the operative direction acquires a target object (21) on the basis of its own radiation, its radiation shadow or its contour relative to the surrounding target area (12). If that acquisition effect should still not have occurred by the time that a remaining height above the target area (12) is reached then—controlled in dependence on height by the sensor (19)—the warhead (22) is moved out of the slightly inclined orientation into the vertical orientation so that a peripheral surface covering of smaller heavy metal cubes (25) is discharged in the form of an approximately horizontal all-around fragmentation fan against any unprotected targets in the vicinity.

5 Claims, 1 Drawing Sheet

SUBMUNITION

BACKGROUND OF THE INVENTION

1. Field of the Invention

The present invention relates to a submunition which is adapted to descend in a parachute-braked mode into a target area, and which incorporates a fragment warhead deployable against semi-hard target objects located in a protected position.

SUMMARY OF THE INVENTION

A submunition of that kind which descends into the target area on a braking parachute is known from U.S. Pat. No. 4,974,515 for use against hard and semi-hard targets in a protected position. For that purpose the cylindrical warhead has a peripheral surface covering of P-charges which, for an all-around fanned-out action, are fired with a mean fragmentation direction which rises slightly with respect to the horizontal when the submunition which has descended into the target area strikes hard against the ground; while the fragmentation direction is inclined slightly downwardly if the braking parachute is comparatively gently and softly caught up in the branches or framework of a protective cover over the target object. Although that operative mechanism has advantages over the conventional bomblets which are used as scatter munition, with radiating hollow-charge inserts which are oriented in an axially forward direction and which, for a desirable effect at the target, must impact directly on to the target object, the operative scenario of the general kind set forth is however ineffective against target objects in semi-protected positions behind earth walls or embankments, stone walls, sandbag barriers or the like.

Although such protection arrangement can be overcome by the known search-fuse submunition, as is described in the German journal WEHRTECHNIK, issue October 1985, on page 115, that is to say by a P-charge warhead which attacks a hard target object from above, hanging from a rotational parachute, while searching a path which is constricted and narrowed down in a spiral configuration, by means of a search-fuse sensor, the technological expenditure for search-fuse P-charge warheads, which are used as submunition, is however justified only for direct tank combat when using an indirect firing mode; in the case of use against semi-hard or unarmoured target objects in a semi-protected position the cost/benefit relationship would be too disadvantageous.

Therefore the technical object of the present invention is to provide a submunition which can be used effectively and inexpensively in particular against semi-hard targets in a semi-covered position and which as far as possible also affords an active component against unprotected unarmoured target objects if the above-mentioned primary target class should have been missed.

In accordance with the invention that object is essentially achieved in that the submunition of the general kind set forth is also equipped with a search-fuse sensor for the acquisition of a target object during the course of rotating descent into the target area, which upon acquisition of a target object initiates a fragment cone of heavy metal balls in an operative direction which is pivoted through a sensor aspect angle in the order of magnitude of approximately 30° relative to the vertical of the descent, and with a search direction of the sensor which is oriented parallel to the operative direction.

In accordance with the construction according to the invention, the attack against a semi-hard target object which is acquired in the circling descent of the submunition along a spirally constricting search path is effected so-to-speak in a buckshot firing mode by a cone of preshaped heavy metal fragments inclinedly from above, that is to say by surmounting the horizontal protection, and against the roof armouring of the target object which is usually of a weaker nature.

If in contrast in the course of the parachute-braked descent there should still be only such a slight residual height above the ground that target attack inclinedly from above is no longer probable, self-destruction of the submunition occurs, with the formation of a substantially horizontal heavy metal fragment fan, with an action against any unprotected target objects which are possibly disposed in the surrounding area. Thus the submunition according to the invention represents an inexpensive and operatively effective combination of a conventional bomblet with the search-fuse function of intelligent submunition.

BRIEF DESCRIPTION OF THE DRAWINGS

Additional alternatives and developments as well as further features and advantages of the invention are apparent from the following description of a preferred operative scenario for the submunition according to the invention, which is diagrammatically illustrated in a manner which is greatly abstracted while being limited to what is essential, and without being entirely to scale. In the drawing.

DETAILED DESCRIPTION OF A PREFERRED EMBODIMENT

Figure 1A:
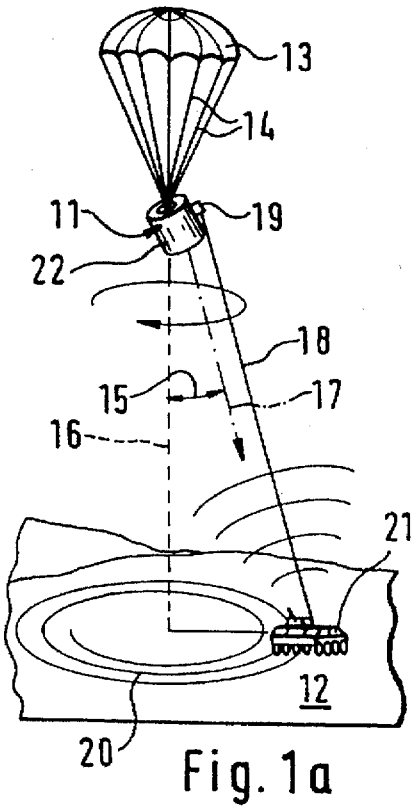
FIGS. 1*a* and 1*b* show the use of this submunition against semi-hard targets from above.

The drawing illustrates one submunition 11 of a plurality which, in an axial array by means of a carrier grenade from a howitzer or, preferably, by means of an artillary rocket from a launcher, were brought into position over a target area 12 which had been the subject of previous reconnaissance and in which semi-hard targets in a semi-covered position (such as armoured personnel locations or advanced command posts behind earth walls or embankments) are to be attacked. The submunitions 11 which are axially ejected from the carrier casing (see above the reference to U.S. Pat. No. 4,974,515) are separated from each other upon being released from the deployment casing and are distributed in the course of aerodynamic braking by means of a braking parachute or a braking balloon or drogue, before the braking device becomes inoperative (in particular being discarded) in order to release a rotational parachute 13. By means of a lever mechanism as is shown in greater detail for example in DE 40 22 445 A1, the submunition 11 is pivotally connected to the lines 14 of the rotational parachute 13 at an aspect angle 15 of the order of magnitude of about 30° (as measured between the vertical 16 and the warhead operative direction 17). That pivotal connection rotates in the course of the parachute-braked descent of the submunition 11 at a few hertz about the vertical 16. As a result, in the course of the parachute-braked descent of the submunition 11 into the target area 12, the search device 18 of a sensor 19 describes in the plane of the target area 12 an approximately circular but spiral-like contracting search path 20, looking for a target object 21 to be attacked. The sensor 19 can operative passively for that target acquisition, that is to say it can respond to electromagnetic radiation energy which originates from the target area 12. This can be height radiation which is reflected and locally shadowed by the target object 21 and which is received by a radiometer sensor 19, or thermal radiation which originates directly from the target object 21 and which is significant relative to the surrounding area and which is received by an infra-red sensor 19. The sensor 19 however may also be an active sensor which, on the principle of the reverse-radiation location technique, scans the terrain in the target area 12 in accordance with the search path 20 and responds to a significant heightwise jump which originates due to the target object 21; or it involves a combination sensor 19 which operates both passively and also actively and which evaluates a signature concurrence for target acquisition, as is known as such from the technology of search-fuse sensor systems (see GB 21 44 523 A).

If the sensor 19, in the region of a descent height of some ten meters above the target area 12, first detects a target object 21, the cylindrical explosive filling of the warhead 22 is detonated and a buckshot firing cone of heavy metal balls 23 with which the end face of the warhead 22, which faces in the operative direction 17, is covered in front of the explosive, is accelerated inclinedly downwardly towards the target object 21. The target 21 is not protected against that direction of action by means of the protective measures against direct bombardment (such as side armour and earth wall) so that this guarantees a great effect for the detonated warhead 22 in the selectively detected target object 21.

Figure 2A:
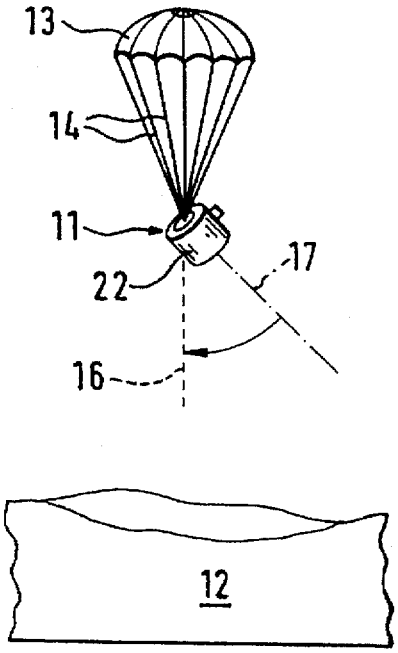
FIGS. 2*a* and 2*b* show the same submunition, now acting laterally against unarmoured targets.
Figure 2B:
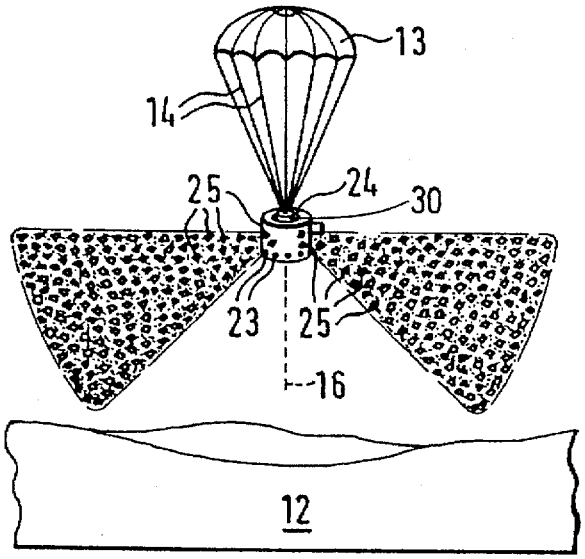

If however in the course of the rotating downward movement of the submunition 11 into the target area 12, a target object 21 to be attacked should still not be detected by the sensor, by a position at some meters above the ground, then, because of the small residual height remaining and the small remaining radius of the search path 20, it is no longer possible to reckon on acquisition of a semi-hard target object 21. The active sensor 19 which acts as a height measuring device or for example an additional radar height measuring device can serve the purpose of signalling that remaining height above the ground. Constructive arresting of the aspect angle 15 is now released on the submunition 11, through the use of a pivoting means 30 mounted on warheads 22, so that the warhead 22 which is still hanging from the rotational parachute 13 pivots into a position such that its operative direction 17 is oriented vertically, due to the effect of the force of gravity. Then, for example when it passes through the vertical 16, which can be detected by sensor means, the fuse or a special self-destruct fuse is initiated in the warhead 22. Heavy metal cubes 25 which are small in comparison with the ball dimensions are accelerated transversely with respect to the above-mentioned direction 17 (that is to say radially with respect to the axis of the cylindrical warhead 22). That results in self-destruction of the submunition 11 at a very low height with all-around formation of a fragment cube fan which is inclined slightly downwardly relative to the horizontal (FIG. 2*b*). That still has an operative radius of some ten meters in relation to unprotected objects such as radar positions, light vehicles or fuel supply tanks.

Figure 1B:
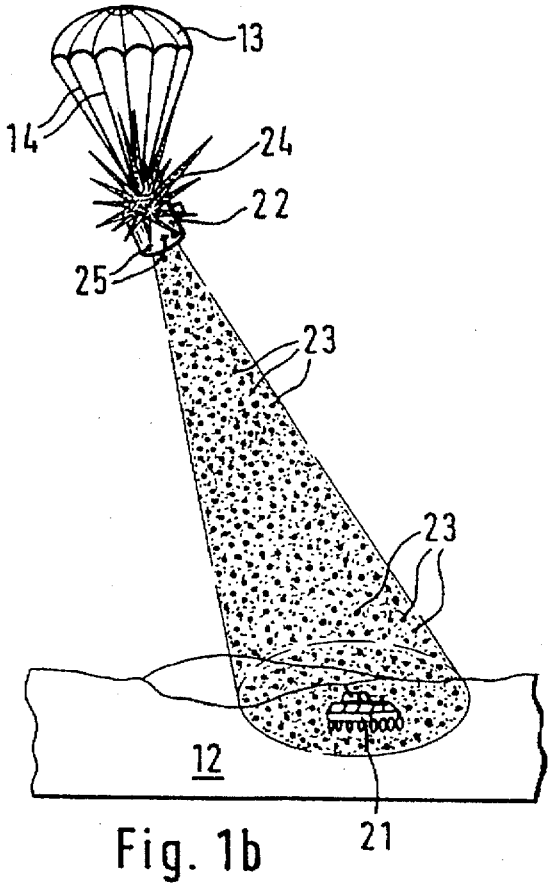

For the purposes of clearer illustration, only the ball fragment cone is shown in FIG. 1*b* and only the fragment cube fan is shown in FIG. 2*b*. In actual fact, upon detonation of the warhead 22, both effects occur simultaneously, but only the one function shows an effect in terms of height and only the other function shows an effect in terms of the relevant plane. By suitable positioning of a plurality of fuses 24 however it is possible to produce a specific detonation action in order selectively to promote both fragment mechanisms.

We claim:

1. Submunition (11) which is attached to shroud lines of a rotational parachute so as to be suspended from a said parachute for the braked descent thereof into a target area (12) while at an aspect angle in the magnitude of about 30° from a vertical about which said submunition is rotated, said submunition including a fragment warhead (22) for deployment against semi-hard target objects (21) located in a protected position, said submunition (11) being equipped with a search-fuse sensor (19) for the acquisition of a target object (21) during the course of rotating descent into the target area (12), said sensor upon acquisition of a target object (21) initiating a first fragmentation effect through the formation of a fragment cone constituted of metal balls (23) in an operative direction (17) which is pivoted through said aspect angle (15) in the order of magnitude of about 30° relative to the vertical of the descent (16), a search direction (18) of the sensor (19) being oriented parallel to the operative direction (17), said fragment warhead (22) upon said submunition descending to a few meters above ground of the target area (12), in the absence of an acquisition of a target object (21) by said sensor, including means for pivoting said submunition from the aspect angle (15) into a vertical descent (16), and means for initiating a radial fan of fragments from a cylindrical wall of said fragmentation warhead triggering a second fragmentation effect which is slightly inclined downwardly relative to the horizontal.

2. Submunition according to claim 1, wherein said fragment warhead (22) has a covering of said metal balls (23) on an end face which is oriented in the operative direction (17).

3. Submunition according to claim 1, wherein a covering of metal cubes (25) is arranged on said cylindrical wall which are smaller in size than the balls (23) which are oriented in the operative direction (17) so as to trigger said second fragmentation effect.

4. Submunition according to claim 1, wherein a single fuse (24) simultaneously triggers both said fragmentation effects.

5. Submunition according to claim 4, wherein said fragment warhead (22) is equipped with a plurality of predeterminably initiatable fuses (24) for selectively reinforcing said fragmentation effects.

* * * * *